United States Patent [19]

Hasvold

[11] 4,230,524

[45] Oct. 28, 1980

[54] METHOD FOR THE PRODUCTION OF UNBLEACHED SULPHITE CELLULOSE OR BLEACHED CELLULOSE FROM A DEFIBRATED KNOT PULP

[75] Inventor: Ketil Hasvold, Sarpsborg, Norway

[73] Assignee: Borregaard A/S, Sarpsborg, Norway

[21] Appl. No.: 52,862

[22] Filed: Jun. 28, 1979

Related U.S. Application Data

[63] Continuation of Ser. No. 916,346, Jun. 16, 1978, abandoned.

[30] Foreign Application Priority Data

Jul. 8, 1977 [NO] Norway ..... 772420

[51] Int. Cl.[3] ..... D21C 3/02; D21C 3/06

[52] U.S. Cl. ..... 162/25; 162/55; 162/65; 162/86

[58] Field of Search ..... 162/65, 84, 86, 25, 162/55

[56] References Cited

U.S. PATENT DOCUMENTS

| | | | |
|---|---|---|---|
| 3,393,121 | 7/1968 | Lea et al. | 162/55 |
| 3,830,688 | 8/1974 | Mannbro | 162/55 |
| 3,886,035 | 5/1975 | Laakso | 162/55 |

OTHER PUBLICATIONS

*Tappi,* vol. 59, No. 11, 11/76, pp. 77–80.

*Primary Examiner*—William F. Smith
*Attorney, Agent, or Firm*—Howson and Howson

[57] ABSTRACT

Knots separated from sulphite cellulose produced by a sulphite cellulose cooking process are converted to unbleached sulphite cellulose by first separating and defibrating the sulphite knots and then treating the defibrated sulphite knots with oxygen under pressure in an alkaline milieu at an elevated temperature. The resultant cellulose may be bleached by itself, or mixed with sulphite cellulose produced from knot-free cellulose pulp for bleaching therewith.

5 Claims, No Drawings

METHOD FOR THE PRODUCTION OF UNBLEACHED SULPHITE CELLULOSE OR BLEACHED CELLULOSE FROM A DEFIBRATED KNOT PULP

This is a continuation of application Ser. No. 916,346 filed June 16, 1978 abandoned.

The present invention relates to the production of an unbleached sulphite cellulose of high brightness, purity and strength from defibrated knots. The unbleached cellulose thus obtained may be utilized as such or in a mixture with conventionally produced unbleached cellulose for bleaching in accordance with a bleaching method known per se.

Knots usually consists of the chip portion that is not pulped by ordinary cellulose digestion. Said knots usually consist mainly of botanic knots but also comprises varying amounts of insufficiently cooked chips. These so-called knots are separated from the cellulose after cooking in the first coarse separation or screening. The knots produced in the sulphite cellulose cooking process to which this invention relates are commonly referred to as sulphite knots.

The amount of knots varies mainly dependent on conditions of cooking and chip quality. Botanic knots alone constitute approximately 1% of the incoming chips. The amount of badly or insufficiently cooked chips is very variable. At optimal cooking conditions and optimal chip quality the knots consist of almost 100% botanic knots. In connection with the cooking of dissolving pulp, the portion of insufficiently cooked chips is, thus, usually negligible. When paper pulp is cooked, however, the amount of knots can in actual practice consitute 3 to 4% of the incoming chips.

Previously the knots from cellulose production were not adequately utilized. At some pulp mills the knots were defibrated and dewatered and a knot pulp containing 25–50% of solids was obtained. Said pulp was sold, but since the supply of knot pulp by far exceeded the demand, the attainable price hardly covered transportation expenses. At other mills it was necessary to burn the knots with other wastes or the knots were deposited.

At some mills experiments have been carried out involving recooking of knots, but this procedure did not turn out to be economic. Experiments with a two-stage prechlorination treatment of the knot pulp have also been carried out, but also turned out to be unacceptable.

Surprisingly, it has now been found that separated knots after defibration are very easily delignified by an oxygen treatment in an alkaline milieu. In this manner the knots are converted into cellulose of approximately normal quality as regards strength, purity and brightness.

Said oxygen treated knot pulp can, if desired, be additionally bleached to normal brightness and purity. The requirements as to bleaching chemicals are of the same magnitude as for conventional cellulose. The yield of bleached and screened cellulose from said knots is approximately 65%.

Oxygen treated knot pulp is used in the production of dissolving pulp as well as paper pulp. Oxygen treated knot pulp is preferably mixed with unbleached cellulose, and it was found that a content of up to 20% of oxygen treated knot pulp in the mixture did not cause any noticeable change of the pulp quality.

As an alkaline source for oxygen bleaching NaOH, $Ca(OH)_2$, $Mg(OH)_2$, or $NH_4OH$ is preferably utilized. In conformity with experiences from conventional oxygen bleaching it was also found that an addition of stabilizers, e.g. $MgCO_3$, also improves the viscosity at a given lignin content.

The invention will now be further disclosed by some examples.

EXAMPLE 1

Oxygen bleaching was carried out on a sample of defibrated knots. The bleaching process was carried out in an autoclave at 110° C. and an oxygen pressure of 8 kp/cm$^2$. The duration of treatment was 45 minutes.

5% NaOH, based on absolutely dry knot pulp, was used as an alkaline source. As a stabilizer 1% of $MgCO_3$ was used.

After said oxygen treatment the pulp was screened on a Jönsson-type WEAP-screen with a screening plate having 0.25 mm slots. The amount of screening reject was 3.5% of the pulp.

The yield of oxygen treated and screened knot pulp was 73%, based on incoming knot pulp.

After oxygen treatment and screening the knot pulp had a kappa number of 12,5 against 102 for non-oxygen treated but screened knot pulp.

The oxygen treated knot pulp was subjected to strength tests according to SCAN-specifications. The results are given in Table 1. For comparison also corresponding data for unbleached sulphite cellulose and for a mixture consisting of 20% of oxygen bleached knot pulp and 80% of unbleached sulphite cellulose are listed in said table.

TABLE 1

| Brightness (Scan) Strength properties (SCAN), | Oxygen treated knot pulp 59 | | 20% of oxygen treated knot pulp + 80% of unbleached sulphite cellulose 59–61 | | Unbleached sulphite cellulose 59–62 | |
|---|---|---|---|---|---|---|
| Rev. PFI-beater | 1000 | 2000 | 1000 | 2000 | 1000 | 2000 |
| °SR | 29 | 42 | 22 | 37 | 22 | 36 |
| Tensile, km | 5,9 | 6,4 | 7,4 | 8,5 | 8,2 | 8,9 |
| Tear factor | 75 | 69 | 81 | 72 | 88 | 73 |
| Double folds | 120 | 210 | 610 | 830 | 850 | 1140 |
| Bulk, cm$^3$/g | 1,45 | 1,35 | 1,39 | 1,32 | 1,45 | 1,20 |

EXAMPLE 2

Oxygen treatment was carried out with a sample of defibrated knots.

The oxygen treatment was carried out in an autoclave at 110° C. and an oxygen pressure of 8 kp/cm$^2$. The duration of treatment was 45 minutes.

5% NaOH, based on absolutely dry knot pulp, was used as an alkaline source. As a stabilizer $MgCO_3$ was used.

After the oxygen treatment the pulp was screened on a Jönsson-type WEAP-screen with a screening plate having 0,25 mm slots. The amount of screening reject was 3.5% of the pulp.

The yield of oxygen treated and screened knot pulp was 73%, based on incoming knot pulp.

After oxygen treatment and screening the knot pulp had a kappa number of 12.5 against 102 of non-oxygen treated but screened pulp.

The oxygen treated knot pulp was then bleached separately and in a mixture rate of 20% oxygen treated knot pulp and 80% conventional unbleached sulphite cellulose according to the following sequence:

1st chlorination stage

Chlorine charged, kg per ton: [0.18.H+0,2]·6

Conditions of treatment: 20 minutes at 20° C. and a pulp consistency of 3.5%.

Alkali stage

Charged NaOH, kg per ton: 30

Conditions of treatment: 75 minutes at 70° C. and a pulp consistency of 12%.

2nd chlorination stage

Charged chlorine, kg per ton: [0.18.H+0,2]·4

Conditions of treatment: 45 minutes at 20° C. and a pulp consistency of 5%.

Hypochlorite stage

Charged active chlorine, kg per ton: 13

Charged NaOH, kg per ton: 9

Conditions of treatment: 6 hours at 44° C. and a pulp consistency of 9%.

For comparison conventional unbleached sulphite cellulose was bleached according to the same sequence.

The results of the bleaching tests are listed in Table 2.

TABLE 2

| | Oxygen treated knot pulp | 20% of oxygen treated knot pulp + 80% of unbleached sulphite cellulose | Unbleached sulphite cellulose |
|---|---|---|---|
| Brightness (SCAN) | 91,3 | 92,7 | 93,0 |
| Resin (SCAN) % | 0,1 | 0,4 | 0,5 |
| Viscosity (SCAN) | | | |

TABLE 2-continued

| | Oxygen treated knot pulp | 20% of oxygen treated knot pulp + 80% of unbleached sulphite cellulose | Unbleached sulphite cellulose |
|---|---|---|---|
| $cm^3/g$ | 560 | 850 | 890 |
| S-18 (SCAN) % | 8,8 | 11,7 | 12,0 |
| Strength properties (SCAN) | | | |
| Rev. PFI-beater | 2000 | 2000 | 2000 |
| °SR | 45 | 28 | 26 |
| Tensile, km | 5,5 | 7,0 | 7,4 |
| Tear factor | 73 | 77 | 77 |
| Double folds | 100 | 500 | 610 |
| Bulk, $cm^3/g$ | 1,5 | 1,37 | 1,37 |

I claim:

1. A method for the production of sulphite cellulose from knots produced in a sulphite cellulose cooking process, comprising:

separating said knots from said sulphite cellulose after said cooking process;

defibrating said knots separated from said sulphite cellulose; and subjecting the separated defibrated sulphite knots, while still separated, to a single-step treatment with oxygen under pressure in an alkaline milieu at an elevated temperature, to thereby produce unbleached sulphite cellulose from said separated defibrated knots.

2. A method as stated in claim 1, wherein said temperature is above 100 degrees C.

3. A method as stated in claim 2, wherein said temperature is about 110 degrees C.

4. A method as stated in claim 1, wherein said alkaline milieu is a material selected from the class consisting of ammonium hydroxide, alkali hydroxide, or alkaline earth hydroxide.

5. A method as stated in claim 1, wherein said temperature is about 110 degrees C., said oxygen pressure is about 8 $kp/cm^2$, and said alkaline milieu comprises a sodium hydroxide solution in a concentration of about 5 weight-% based on pulp weight.

* * * * *